US012264853B2

(12) United States Patent
Gopalan et al.

(10) Patent No.: US 12,264,853 B2
(45) Date of Patent: Apr. 1, 2025

(54) OIL SEPARATOR AND RETURN FOR EJECTOR-BASED DIRECT EXPANSION (DX) EVAPORATOR

(71) Applicant: Evapco, Inc., Taneytown, MD (US)

(72) Inventors: Shri Gopalan, Westminster, MD (US); Greg Derosier, Eldersburg, MD (US)

(73) Assignee: Evapco, Inc, Taneytown, MD (US)

( * ) Notice: Subject to any disclaimer, the term of this patent is extended or adjusted under 35 U.S.C. 154(b) by 0 days.

(21) Appl. No.: 18/497,677

(22) Filed: Oct. 30, 2023

(65) Prior Publication Data

US 2024/0142141 A1 May 2, 2024

Related U.S. Application Data

(60) Provisional application No. 63/420,187, filed on Oct. 28, 2022.

(51) Int. Cl.
*F25B 9/08* (2006.01)
*F25B 1/10* (2006.01)

(52) U.S. Cl.
CPC ..... *F25B 1/10* (2013.01); *F25B 9/08* (2013.01); *F25B 2341/0011* (2013.01); *F25B 2400/23* (2013.01)

(58) Field of Classification Search
CPC ..... F25B 1/10; F25B 2341/0011; F25B 2341/0016; F25B 2400/23; F25B 2400/03; F25B 43/006; F25B 43/02; F25B 2313/001
See application file for complete search history.

(56) References Cited

U.S. PATENT DOCUMENTS 3,283,532 A * 11/1966 Kocher ..... F25B 43/02 62/84
2012/0297818 A1 11/2012 Toyama et al.
2013/0186128 A1 7/2013 Kim et al.
2017/0268808 A1 9/2017 Rahhal et al.
2020/0141620 A1* 5/2020 Derosier ..... F25B 41/00

FOREIGN PATENT DOCUMENTS

CN 204373252 U * 6/2015
CN 111059806 A * 4/2020 ..... F24F 5/001

OTHER PUBLICATIONS

English translation of Zhao et al. (CN 204373252 U). (Year: 2015).*
International Search Report issued in co-pending application No. PCT/US 23/78214, dated Mar. 15, 2024.

* cited by examiner

*Primary Examiner* — Miguel A Diaz
(74) *Attorney, Agent, or Firm* — Whiteford, Taylor & Preston, LLP; Peter J. Davis

(57) ABSTRACT

A system and method for increasing the refrigeration capacity of a direct expansion refrigeration system having a vapor separator and a vapor ejector. After the throttling process at the expansion device, the mixture of liquid and vapor enters the inlet separator. The vapor separator generates vapor to power the ejector through flashing of warm refrigerant liquid from a higher temperature and pressure to a lower pressure. The cooler refrigerant liquid then goes to the evaporator coil inlet. The vapor goes to the ejector as well as refrigerant vapor from the outlet of the evaporator. The ejector sends oil and vapor and liquid refrigerant to an oil separator which returns oil to the compressor and sends the liquid and vapor refrigerant to the evaporator.

6 Claims, 5 Drawing Sheets

OIL SEPARATOR AND RETURN FOR EJECTOR-BASED DIRECT EXPANSION (DX) EVAPORATOR

BACKGROUND OF THE INVENTION

Field of the Invention

The present invention relates to direct expansion evaporator refrigeration systems

Description of the Background

Refrigerant oil is used in a Refrigeration cycle to lubricate the Compressor internal moving parts, cool and enable good sealing. Even with good oil separation, a very small portion of the oil is carried by the refrigerant throughout the system with an affinity to collect in the suction header of the evaporator. It is important the oil be removed from the evaporator and returned to the compressor. Oil return is commonly achieved when the refrigeration cycle utilizes hot gas defrost. However, not all systems are arranged with hot gas defrost.

SUMMARY OF THE INVENTION

The Ejector DX Evaporator boosts cooling capacity over traditional DX by up to 38%. This boost in cooling capacity is achieved by recirculating liquid refrigerant from the suction header back to the distributor with an ejector and superheated vapor exits the top suction connection similar to a DX evaporator. This raises a potential issue with refrigerant oil to be recirculated back and potentially accumulating in the evaporator coil tubes. The purpose of the present invention is to alleviate this potential issue by separating and collecting refrigerant oil from the refrigerant downstream of the ejector and intermittently returning to the suction connection.

BRIEF DESCRIPTION OF THE DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

Figure 1:
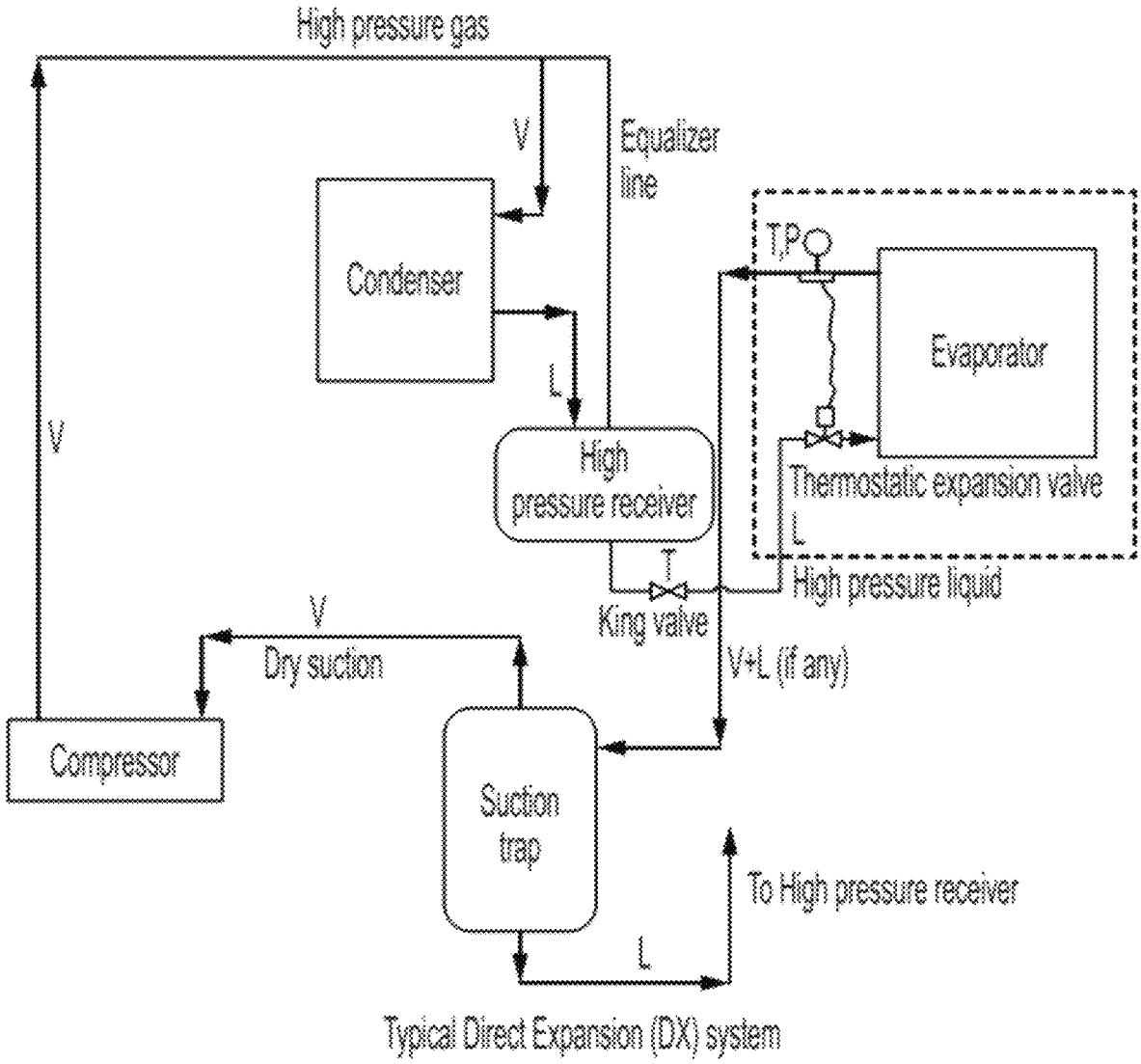
FIG. 1 is a representation of a standard direct expansion refrigeration system.

Features in the attached drawings are numbered with the following reference numerals:

| | |
|---|---|
| 3 expansion device. | 13 inlet separator vapor outlet |
| 5 expansion device outlet | 15 inlet separator liquid outlet |

-continued

Features in the attached drawings are numbered with the following reference numerals:

| | |
|---|---|
| 7 refrigerant line | 16 refrigerant line |
| 9 inlet to inlet separator | 17 distributor inlet |
| 11 inlet separator | 18 refrigerant line |
| 19 distributor | 35 ejector liquid inlet |
| 21 distributor outlet | 37 ejector outlet |
| 23 evaporator inlets | 39 refrigerant line |
| 25 evaporator | 41 outlet separator inlet |
| 26 refrigerant line | 46 refrigerant line |
| 27 evaporator outlet | 57 refrigerant line |
| 29 refrigerant line | 100 superheat sensor |
| 30 refrigerant line | 102 controller |
| 31 ejector vapor inlet | 103 refrigerant line |
| 33 ejector | |

DETAILED DESCRIPTION OF THE INVENTION

FIG. 1 shows a typical standard direct expansion (DX) refrigeration system. High pressure, cooled refrigerant from high pressure receiver enters the evaporator through a thermostatic expansion valve and a distributor. The thermostatic expansion valve regulates (opens or closes) based on the superheat of the outlet vapor with the goal of generating superheated vapor (superheat ≥6° F.) to ensure dry suction for the compressor. However, this is not the case in practice, as unevaporated liquid tends to escape the evaporator resulting in reduction in superheat and closing of the thermostatic expansion valve to reduce the refrigerant flow rate. This reduces refrigeration capacity. Furthermore, there is also a need for a suction trap as shown in FIG. 1 to trap any liquid and ensure dry suction to the compressor.

A DX system as described above, which uses a distributor to distribute liquid to all circuits of the evaporator is also sensitive to mal-distributions. Non-uniform distribution results in excess liquid flowing out of some circuit outlets, which will reduce superheat below target. This causes the thermostatic expansion valve to increase superheat back to target at the cost of reduced capacity.

Figure 2:
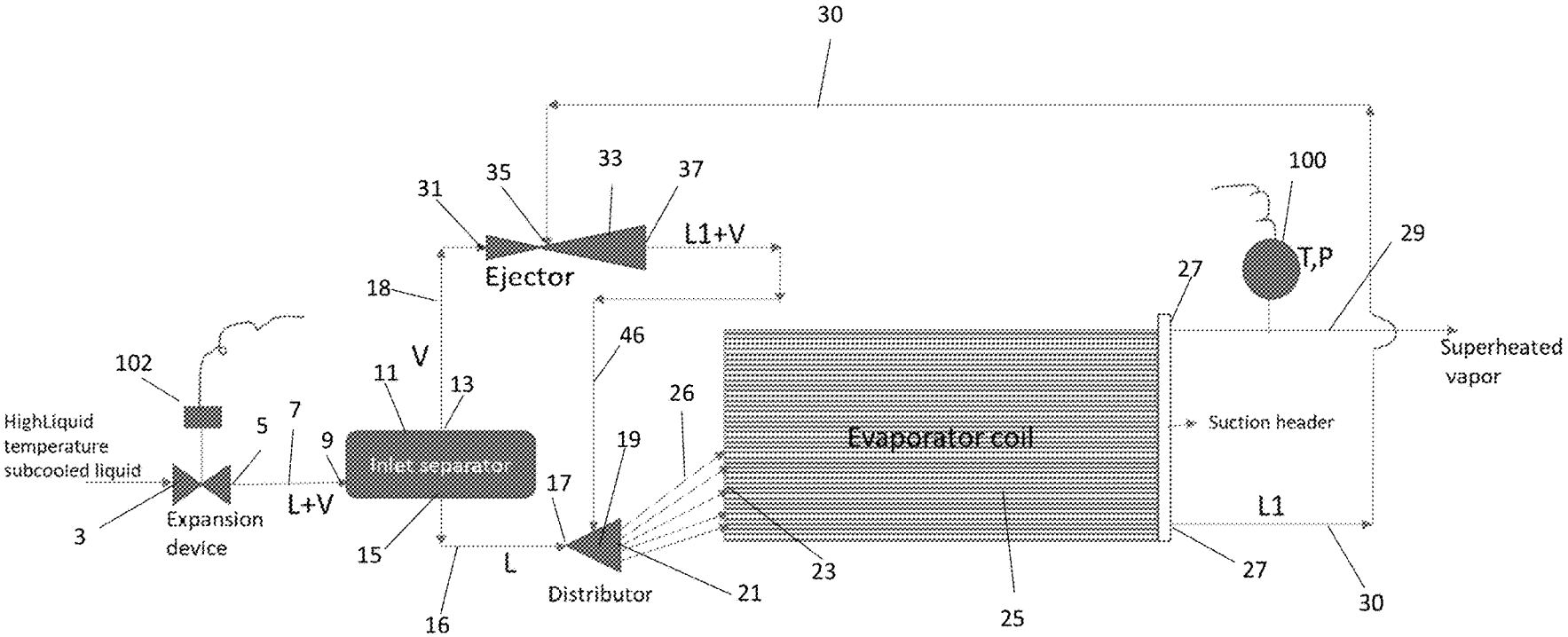
FIG. 2 is a representation of a direct expansion evaporator with vapor ejector capacity boost (Ejector DX Evaporator)

FIG. 2 shows the portion of a DX refrigeration system which replaces the portion of a DX refrigeration system that is enclosed in dashed lines in FIG. 1, specifically including an Ejector DX Evaporator (U.S. Pat. No. 11,3493,245 and U.S. Ser. No. 18/350,739, the entireties of which are incorporated herein by reference). The ejector, which is a fluid enthalpy pump with refrigerant vapor as motive recirculates refrigerant liquid (L1) from the bottom of the suction header back to the side port of the distributor as shown. The evaporator thus operates in an "overfeed" condition resulting in boosted cooling capacity while the fluid exiting from the suction connection is superheated vapor with no liquid carryover like traditional DX.

Referring to FIG. 2, high pressure, cooled refrigerant is delivered to expansion device 3. The outlet 5 of the expansion device 3 is connected via refrigerant line 7 to the inlet 9 of an inlet separator 11, which sends vapor flash gas received from the expansion device to inlet 31 of an ejector 33, while liquid refrigerant is sent from inlet separator outlet 15 to the inlet 17 of distributor 19 via refrigerant line 16. Distributor outlets 21 are connected to the evaporator coil 25 via refrigerant lines 26 for delivery of refrigerant liquid to the evaporator inlets 23 of evaporator coil 25. While an evaporator coil is used as an example herein, any type of evaporator may be used in connection with the invention.

Outlets 27 of the evaporator coil 25 produces both superheated vapor and unevaporated liquid. The superheated vapor is sent to the suction trap and/or compressor via refrigerant line 29, and the unevaporated liquid is sent to the liquid inlet 35 of the ejector 33 via refrigerant line 30. Sensor 100 measures the temperature and pressure of the superheated vapor and sends it to controller 102 to determine whether superheat has been achieved. Controller 102 causes the expansion device to open or close depending on the superheat determination.

Meanwhile, ejector 33 uses the flash gas received from outlet 13 of inlet separator 11 to pump/entrain the unevaporated liquid via refrigerant line 18, and the outlet 37 of the ejector 33 delivers the entrained refrigerant liquid and excess flash gas to the distributor 19 via refrigerant line 46.

Figure 3:
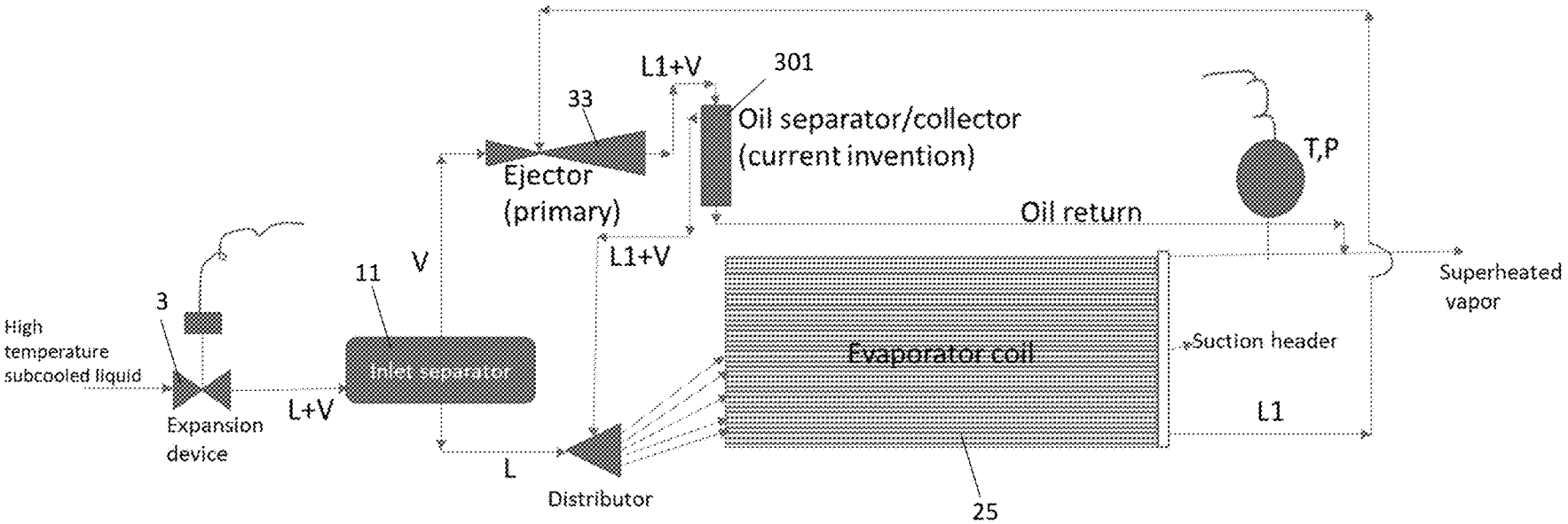
FIG. 3 shows an Ejector DX Evaporator schematic along with an oil separator/collector according to an embodiment of the invention at the outlet of the ejector.

FIG. 3 shows an Ejector DX Evaporator schematic similar to the Ejector DX Evaporator of FIG. 2, but with an oil separator/collector 301 at the outlet of the ejector 33 according to the present invention. This invention is necessary for Ejector DX evaporators that are not equipped with Hot Gas (HG) defrost to return oil to the compressor. That is, Ejector DX circuits are bottom fed, which enables oil return during hot gas defrost. In such cases hot gas is pumped into the suction header through the suction connection and makes its way to the coil tubes. The condensate formed from defrost exits out through the circuits into the distributor and eventually exits from the side port of the distributor. Refrigerant oil in the coil tubes is also pushed out along with the condensate and hot gas through the side port of the distributor.

However, for Ejector DX without HG defrost, there is potential for oil to accumulate in the coil tubes due to the recirculation of liquid refrigerant from the suction header and no active means to return oil. The present invention is specifically intended for such applications to separate, collect and intermittently return refrigerant oil to the suction connection as shown in FIG. 3.

Figure 4:
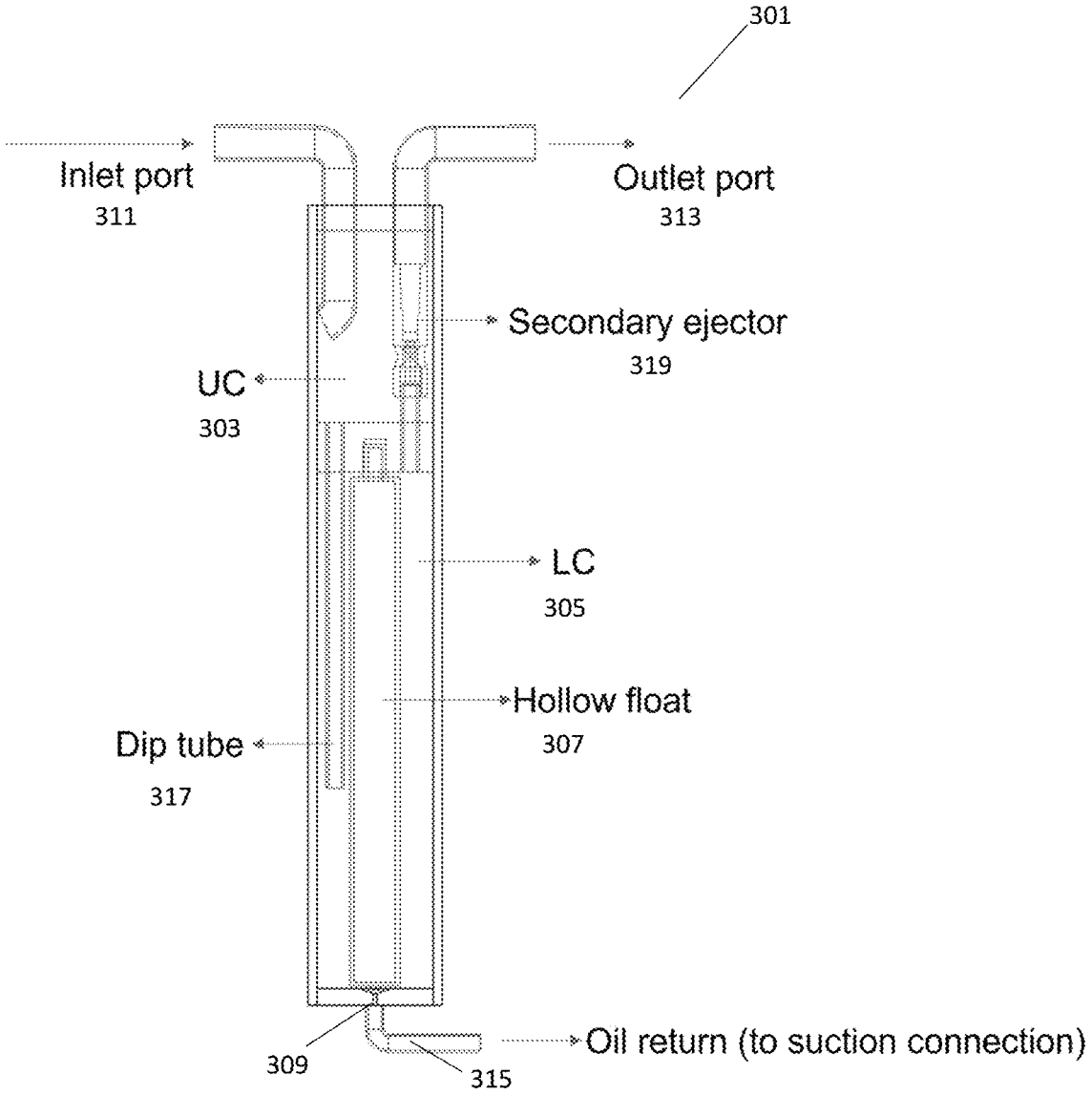
FIG. 4 shows an oil separator/collector according to an embodiment of the invention.

FIG. 4 shows an oil separator/collector 301 according to an embodiment of the invention. It has two chambers, upper (UC) 303 and lower (LC) 305 where a hollow float 6 return. The oil separator also has an inlet port 311, outlet port 313 and an oil return line 315 on the bottom. The inlet port 311 of the UC 303 receives vapor+liquid refrigerant+oil from the primary ejector 33 as shown in FIG. 3. The UC 303 has a long dip tube 317 leading into the LC 305. The liquid/oil being denser than vapor quickly enters the LC 305 through the dip tube 317. This is a separation or stratification technique for the denser oil/oil rich refrigerant to move to the bottom of the LC 305, while lighter refrigerant moves to the top of the LC. The vapor on the other hand, enters a secondary ejector 319 as shown, that bridges the LC 305 to the outlet port 313 of the Oil separator. The secondary ejector 319 (described below) is operated by vapor motive, while its entrainment tube 321 is connected to the top of the LC 305 as shown in figure. As the vapor motive moves through the secondary ejector 319, it draws liquid from the top of the LC 305 and vapor-liquid mixture exit through the outlet port 313 to the distributor side port as shown in FIG. 3. The denser oil/oil-rich liquid remains on the bottom of the LC 305 and gradually builds a level, since the LC 305 is quite quiescent with little fluid motion. As the level of oil rich refrigerant builds in the LC 305, the float 307 is designed to open due to buoyancy when the level exceeds approximately 75% of the height of the float. When the float lifts, small quantity of oil exits through the orifice 309 on the bottom and makes its way to the suction connection.

The invention is particularly suited for liquid refrigerants that have a lower density than the refrigerant oil. An example would be Ammonia refrigerant and FES #1 compressor oil, which has a specific gravity of 0.87.

Figure 5:
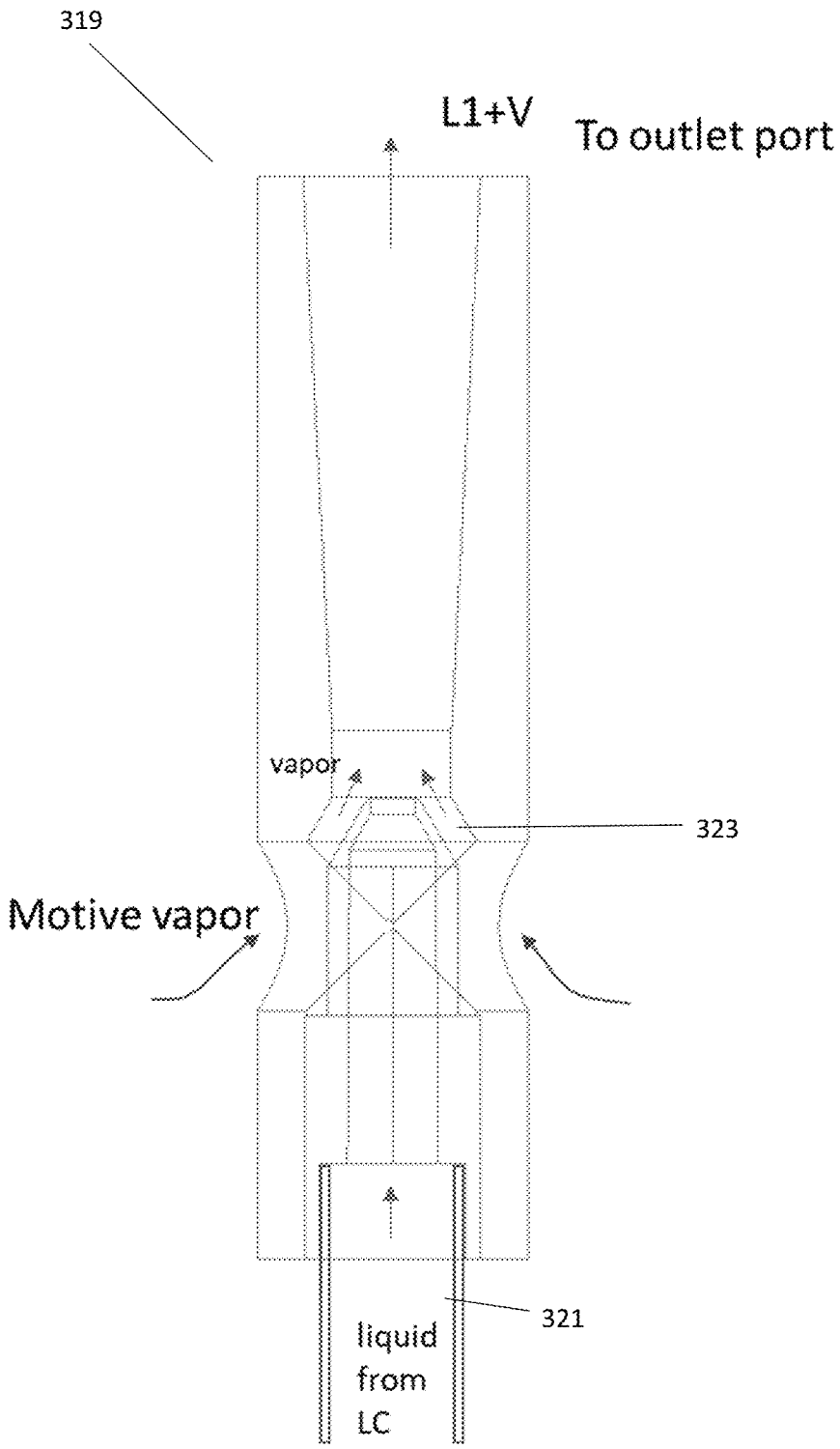
FIG. 5 is/shows a secondary ejector bridged between outlet port and LC according to an embodiment of the invention.

A sketch of the secondary ejector is shown in FIG. 5. The function of the secondary ejector 319 is to remove oil-free liquid refrigerant (when present) from the top of the LC 305. It does so by using motive vapor and operates at a very low pressure drop, preferably 0.5 psi or less. The secondary ejector 319 has an annular passage 323 for the vapor to increase its velocity, while liquid refrigerant is entrained from the center entrainment 321 tube connected to the top of the LC 305. Typical mass flow entrainment ratios for this device are 2 to 3 and exceeds the entrainment ratio of the primary ejector 33 so that liquid refrigerant does not flood the UC 303.

The efficacy of this oil separator 301 lies in the fact that liquid refrigerant/oil mixture tends to be drawn into the LC 305 through the long dip tube 317, while vapor quickly moves through the ejector ports to the outlet. The lighter liquid refrigerant then floats to the top of the LC 305 by gravity while oil/oil-rich refrigerant tends to move to the bottom. The addition of the secondary ejector 319 ensures that lighter liquid can be skimmed from the top of the LC 305, while providing plenty of settling time for the oil to separate out and collect in the bottom.

Once sufficient oil level collects, the float valve lifts due to buoyancy that discharges oil into the suction connection through the orifice.

Several prototypes have been including a full size prototype which handled more than 1 lb/min of vapor and more than 2 lb/min of liquid flow. These flows are the maximum expected from a large cooling capacity evaporator coil (e.g. 50 TR).

It will be appreciated by those skilled in the art that changes could be made to the preferred embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification.

The invention claimed is:

1. An apparatus for improving the performance of a direct expansion refrigeration system, the apparatus comprising:

an inlet separator adapted to be connected to an expansion device outlet of said direct expansion refrigeration system, an evaporator connected to a liquid outlet of said inlet separator, an ejector connected to a vapor outlet of said inlet separator, a first refrigeration line connecting a first outlet of said evaporator to a liquid inlet of said ejector, a second refrigeration line connecting a second outlet of said evaporator to a compressor, an oil separator connected in a refrigerant flow path between to an outlet of said ejector and an inlet of said compressor, said oil separator connected in a second refrigerant flow path between said outlet of said ejector and an inlet of said evaporator;

a third refrigeration line connecting an oil separator first outlet to said compressor;

a fourth refrigeration line connecting an oil separator second outlet to said evaporator and configured to deliver liquid refrigerant to said evaporator;

said inlet separator configured to simultaneously and continuously deliver refrigerant vapor to said ejector and refrigerant liquid to said evaporator, said ejector configured to deliver oil, refrigerant vapor, and refrigerant liquid to said oil separator, said oil separator configured to deliver oil to said compressor and refrigerant vapor and refrigerant liquid to said evaporator.

2. The apparatus of claim 1, wherein said oil separator comprises a vertically oriented tube having an upper chamber and a lower chamber, the upper chamber having an upper chamber inlet port and an upper chamber outlet port, said lower chamber having a float situated above an oil return outlet;

said upper chamber connected to said lower chamber by a dip tube configured to allow the passage of oil and liquid refrigerant and liquid refrigerant into said lower chamber, and an inlet tube for said secondary ejector for the passage of liquid refrigerant from said lower chamber into said secondary ejector.

3. The direct expansion refrigeration system according to claim 1, wherein said inlet separator and said ejector are combined in an integrated refrigerant recycling device.

4. A direct expansion refrigeration system comprising:

a refrigerant line connecting the following, in order:

an expansion device, an inlet separator, an evaporator, and a compressor, said refrigeration system further comprising an ejector connected to an outlet of said inlet separator and to an outlet of said evaporator, and an ejector outlet connected to an oil separator, said oil separator having a first outlet configured for returning oil to said compressor and a second outlet for delivering liquid refrigerant and vapor refrigerant to said evaporator;

said inlet separator configured to simultaneously and continuously deliver refrigerant vapor to said ejector and refrigerant liquid to said evaporator;

said oil separator comprising a vertically oriented tube having an upper chamber and a lower chamber, the upper chamber having an upper chamber inlet port and an upper chamber outlet port, said lower chamber having a float situated above an oil return outlet;

said upper chamber connected to said lower chamber by a dip tube configured to allow the passage of oil and liquid refrigerant and liquid refrigerant into said lower chamber, and an inlet tube for said secondary ejector for the passage of liquid refrigerant from said lower chamber into said secondary ejector.

5. A direct expansion refrigeration system according to claim 4, wherein said inlet separator and said ejector are combined in an integrated refrigerant recycling device.

6. A method for increasing the refrigeration capacity of a direct expansion refrigeration system comprising the following steps, simultaneously:

taking liquid refrigerant from an outlet of an evaporator and delivering it to an ejector, taking refrigerant vapor from an inlet separator located upstream of said evaporator and delivering it to said ejector, using said ejector to warm said refrigerant liquid received from said evaporator with said vapor received from said inlet separator;

delivering liquid refrigerant, vapor refrigerant and oil from said ejector and delivering it to an oil separator;

delivering oil from said oil separator to a compressor, delivering liquid refrigerant and vapor refrigerant from said oil separator to said evaporator, said method further comprising allowing said oil to settle in an lower chamber of said oil separator below a liquid refrigerant level, and using a secondary ejector located in an upper chamber containing vapor refrigerant, and using said vapor refrigerant in said secondary ejector as a motive force to entrain liquid refrigerant from said lower chamber into a feed tube of said secondary ejector to drive said liquid refrigerant and said vapor refrigerant to said evaporator from said oil separator.

* * * * *